US005544800A

United States Patent [19]

Armstrong

[11] Patent Number: 5,544,800

[45] Date of Patent: Aug. 13, 1996

[54] SELF-POWERED FASTENER SYSTEM

[75] Inventor: William D. Armstrong, Dallas, Tex.

[73] Assignee: Innovative Quality Products Corporation, Dallas, Tex.

[21] Appl. No.: 450,883

[22] Filed: May 26, 1995

Related U.S. Application Data

[62] Division of Ser. No. 147,577, Nov. 5, 1993, Pat. No. 5,423,469.

[51] Int. Cl.[6] ..... B25C 1/10

[52] U.S. Cl. ..... 227/009

[58] Field of Search ..... 227/9, 10, 11; 411/440, 923

[56] References Cited

U.S. PATENT DOCUMENTS

| | | | |
|---|---|---|---|
| 1,365,869 | 1/1921 | Temple | 227/9 |
| 2,395,354 | 2/1946 | Temple | 227/9 |
| 3,029,434 | 4/1962 | Henning et al. . | |
| 3,172,123 | 3/1965 | Helderman et al. . | |
| 3,363,817 | 1/1968 | Brack . | |
| 3,398,684 | 8/1968 | Kvavle . | |
| 3,514,025 | 5/1970 | Hsu et al. . | |
| 3,559,272 | 2/1971 | Hsu . | |
| 3,648,616 | 3/1972 | Hsu . | |
| 3,665,583 | 5/1972 | Helderman . | |
| 3,797,721 | 3/1974 | Clumb . | |
| 3,805,472 | 4/1974 | Helderman . | |
| 4,093,110 | 6/1978 | Johnson . | |
| 4,241,747 | 6/1981 | Bendler et al. . | |
| 4,830,254 | 5/1989 | Hsu . | |
| 4,890,778 | 1/1990 | Hawkins . | |
| 4,899,919 | 2/1990 | Clumb . | |
| 5,016,802 | 5/1991 | Haytayan | 227/9 |
| 5,135,150 | 8/1992 | Chun | 227/9 |
| 5,215,419 | 6/1993 | Steinhilber . | |

FOREIGN PATENT DOCUMENTS

| | | |
|---|---|---|
| 214148 | 10/1993 | Taiwan . |
| 696192 | 11/1979 | U.S.S.R. . |

OTHER PUBLICATIONS

Copy of International Search Report dated Jan. 9, 1995.

Preliminary Examination Written Opinion dated Aug. 23, 1995.

Gunnebo Fastening Systems Distributor Price List, Gunnebo Corp., Bristol, CT (Nov. 1, 1984).

*Primary Examiner*—Scott A. Smith

*Attorney, Agent, or Firm*—Wigman, Cohen, Leitner & Myers, P.C.

[57] ABSTRACT

A zero stand-off tool and system for driving a powered fastener into a target work surface. A tool is provided having a reciprocable firing pin for detonating a power charge in a powered fastener supported within the tool. An exhaust gas chamber is provided in the tool for reducing noise. A powered fastener is provided having a receptacle end in which a nitrocellulose composition charge is mounted. The receptacle end has a cylindrical portion and a conical portion. The cooperation of the target work surface, the pointed end of the fastener, the fastener support portion of the tool, the firing pin and the shape of the receptacle end of the fastener serve to detonate the power charge and drive the fastener into the work surface.

10 Claims, 4 Drawing Sheets

SELF-POWERED FASTENER SYSTEM

This is a Division application of Ser. No. 08/147,577, filed Nov. 5, 1993, now U.S. Pat. No. 5,423,469.

FIELD OF THE INVENTION

The present invention relates to self-powered fasteners and systems for driving them into hardened solid structures such as concrete or structural steel. More specifically, the invention relates to a non-free flight low velocity self-powered fastener system comprising a powered fastener bearing a power charge of rapidly combustible and consumable material which together with a tool for activating the powered fastener provide a combustion or detonation chamber which results in a high specific power of the powered fastener and essentially complete consumption of the power charge.

BACKGROUND OF THE INVENTION

The present invention is related to driving fasteners into hardened structures such as concrete ceilings and floors, concrete columns and structural steel members such as I-beams. When such fasteners are to be driven, the working quarters are sometimes cramped with existing structures and equipment. This may result in awkward or limited access to the sites to which the fasteners are to be mounted. This is especially the case with ceilings, which frequently require the use of poles to hold the driving tool in place. Compounding these circumstances is the frequent requirement that a large number of fasteners be mounted, as in the case of suspended ceilings, as known in the art. Thus, efforts have been undertaken to improve worker productivity, while not sacrificing safety. Fasteners have been driven into such structures using various explosive, detonatable, ignitable or combustible charges.

Various types of systems have been used in the prior art. Such systems are characterized as low velocity (discharging a fastener at less than approximately 300 feet/second), medium velocity (discharging a fastener at a velocity of 300–500 feet/second), high velocity (discharging a fastener at a velocity of greater than 500 feet/second), and zero stand-off systems. All but the zero stand-off systems are characterized as being ballistic in nature, because the fasteners can attain free flight. Such systems have safety concerns analogous to handling firearms, but have found application in imbedding fasteners in particularly hard structures in which considerable penetration depths of the fasteners are desired.

The zero stand off-type systems do not achieve free flight of the fasteners. These systems have reduced similarities to firearms, but often at the expense of sufficient power to achieve the desired holding penetration in the target structure. A common characteristic of this second type of system is to use the presence of the target structure or work surface as a necessary prerequisite to actuating the firing of the power charge. This is typically achieved by providing a barrel structure having a bore therein for holding a power charge or cartridge and a fastener. The fastener extends out of the barrel and into contact with the work surface. When the barrel is driven toward the work surface, the fastener is driven inwardly toward the cartridge and serves as a firing pin for detonating or igniting the charge in the cartridge. This results in the compressed ignition gases resulting from the ignited power charge forcing the fastener out of the barrel and into the work surface of the target structure.

Hence, as a result of the cooperation of the work surface, barrel, power charge and fastener, with the fastener functioning as a firing pin, a relatively safe, non-ballistic or non-free flight system is provided. Unfortunately, in the prior art systems, the power achieved and hence the degree of penetration of the fastener into the target structure are limited.

Exemplary of such zero stand-off tools for driving explosive-actuated or self-energized fasteners is the tool of U.S. Pat. No. 3,797,721 to Clumb. That patent discloses a tool having a barrel with a bore for positioning the fastener to be driven. The bore is stepped with a shoulder at the muzzle for supporting a guide washer friction-fitted to and slidable along the fastener. A second shoulder is provided for supporting the rim of an explosive charge cartridge. The portion of the bore beneath the second shoulder defines an explosive chamber. A closed gas expansion chamber surrounds the barrel and communicates with the bore through a plurality of outwardly opening frusto-conical passageways. In operation, the explosive charge cartridge is loaded into the bore. The fastener is then placed in the muzzle of the bore. By placing the pointed end of the fastener against the work surface and either striking the end of the tool or striking the fastener against the work surface, the fastener slides along the bore against the explosive charge cartridge, thereby serving as a firing pin and detonating the charge and forcing the fastener into the work surface.

Similarly, U.S. Pat. No. 3,172,123 to Helderman et al. discloses a system in which a spring-loaded barrel is forced toward the work surface, thereby forcing the fastener inwardly into the bore of the barrel to act as a firing pin for igniting a power charge disposed at the head end of the fastener.

A self-energizing fastener system is disclosed in U.S. Pat. No. 4,899,919 to Clumb. That patent also discloses a tool in which the fastener is to be forced against a protrusion inside the barrel of the tool with the fastener serving as a firing pin in order to ignite the power charge. The fastener includes a pellet propellant charge which is affixed to the head of the fastener. A similar fastener is shown in U.S. Pat. No. 3,559,272 to Hsu, in which a power pill is attached to the head of a drive pin.

Materials used for power charges have included nitrocellulose in various forms. Exemplary of such power charges are those disclosed in Clumb '919 and Hsu '272, as well as in multistage power loads disclosed in U.S. Pat. No. 3,648,616 to Hsu and in caseless cartridges disclosed in U.S. Pat. No. 3,398,684 to Kvavle.

Mounting of a suspension clip to a fastener is also addressed in the prior art. U.S. Pat. Nos. 3,665,583 and 3,805,472 to Helderman are each directed to a fastener and suspension clip structure which includes a retaining flange for facilitating the holding of the suspension clip on a power actuated tool so that the clip can be fastened to a ceiling by a fastener stud to be driven by the tool. The clip is flattened to conform to the barrel muzzle, with a hole provided to accommodate the fastener stud. A tool, similar to that disclosed in the Clumb '721 patent, is also described.

SUMMARY OF THE INVENTION

While various prior art zero stand-off tools and systems have been developed to achieve surface-actuated non-free flight propulsion of the fastener, the power levels achieved and the degree of penetration have been less than desirable. The present invention addresses this shortcoming by providing a system which provides for a powered fastener to be held in contact with the work surface and a reciprocably movable firing pin assembly for igniting a power charge mounted on the fastener in a receptacle having a cylindrical portion and a conical portion formed in the head of the fastener. An angle clip for holding a ceiling wire is also mounted on the fastener. Because a combined powered fastener and angle clip can be loaded at one time, worker productivity is also improved.

A preferred embodiment of a tool and two embodiments of a powered fastener are provided in accordance with the present invention. In the tool embodiment, a tool having a barrel and associated housing is provided which supports a spring-biased firing pin. Exhaust ports (preferably frusto-conical in shape) are provided which lead to an exhaust chamber for noise reduction having spring-biased baffles disposed therein. The barrel has a bore which defines a fastener receiving and discharge chamber. A first embodiment of a fastener is provided having a primerless power charge (preferably of nitrocellulose) fitted to a receptacle at the end thereof with the receptacle having a cylindrical portion and a conical portion. The preferred power charge is a nitrocellulose composition which is press fit into the cylindrical portion of the fastener head receptable. An air space or gap exists between the power charge and the conical portion of the receptacle. The power charge is sealed at its outer surface by an acetone coating. An angle clip having an essentially inverted conical concave surface is mounted on the fastener. The angle clip is press fit or friction fit onto the fastener at a shoulder or step in the fastener. The shape of the concave surface conforms to the bevelled entrance to the tool muzzle so as to align the fastener within the base. The tool is adapted to be threadably mounted on a pole. In operation, a powered fastener is placed in the muzzle of the tool. The penetration or pointed end of the fastener extends outwardly from the muzzle end of the barrel. The head of the fastener, bearing the power charge is supported against a shoulder in the bore of the barrel, at the base of the receiving and discharge chamber. The vertical alignment of the fastener is assisted by the angle clip in contact with the beveled entrance to the nuzzle. The fastener point is placed against the target work surface. When a vertical thrusting force is applied to the handle end of the tool opposite the muzzle end, the firing pin is forced against the power charge of the fastener. The fastener does not move, as in the prior art. Rather, the firing pin penetrates the power charge material. The concussion of the firing pin impact on the power charge combined with a shearing force of the firing pin penetrating the power charge material results in deformation and friction within the power charge, causing the power charge to ignite or detonate. The resulting combustion gases expand and force the fastener into the target work surface. The space between the receiving and discharge chamber shoulder and the fastener head serves as the combustion chamber. The specific conical portion of the fastener head receptacle cavity serves to enhance the propulsion of the fastener toward the work surface by providing a source of air for detonation and as a surface against which the resulting gases expand. As the fastener leaves the tool, the spring which biases the firing pin forces the remainder of the tool up against the target work surface, thereby restoring the firing pin to its at-rest position. This action also helps to maintain the angle clip attached to the fastener flush against the work surface- The fastener slides relative to the concave surface on the angle clip as it is driven, thus retaining the angle clip on the fastener. As the fastener passes the exhaust ports, the expanding gases are forced through the ports into the exhaust chamber. As the gases pass through the baffles, the gases cause the spaces between the baffles to become pressurized, thereby expanding the spaces, forcing the baffles apart. This compresses the baffle spring disposed within the exhaust chamber. The exhaust gas energy is dissipated, thereby reducing noise out of the muzzle, A second embodiment of the powered fastener provides an insert also having a cylindrical portion and a conical portion which is fitted to the fastener head receptacle- The insert in turn holds the power charge. The operation of the charge is otherwise the same.

It is contemplated that the tool can be provided with an increased stroke, for driving longer fasteners, with the attendant dimensions of the components of the tool also increased. The operation of the tool having increased stroke is otherwise the same, Similarly, the tip of the firing pin can be provided with a shoulder or step or other reduced area surface, so that by decreasing the surface area in impact with the power charge, the pressure applied is increased for the same applied force.

With the foregoing and other advantages and features of the invention that will become hereinafter apparent, the nature of the invention may be more clearly understood by reference to the following detailed description of the invention, the appended claims and to the several views illustrated in the attached drawings.

DETAILED DESCRIPTION OF THE INVENTION

Figure 1:
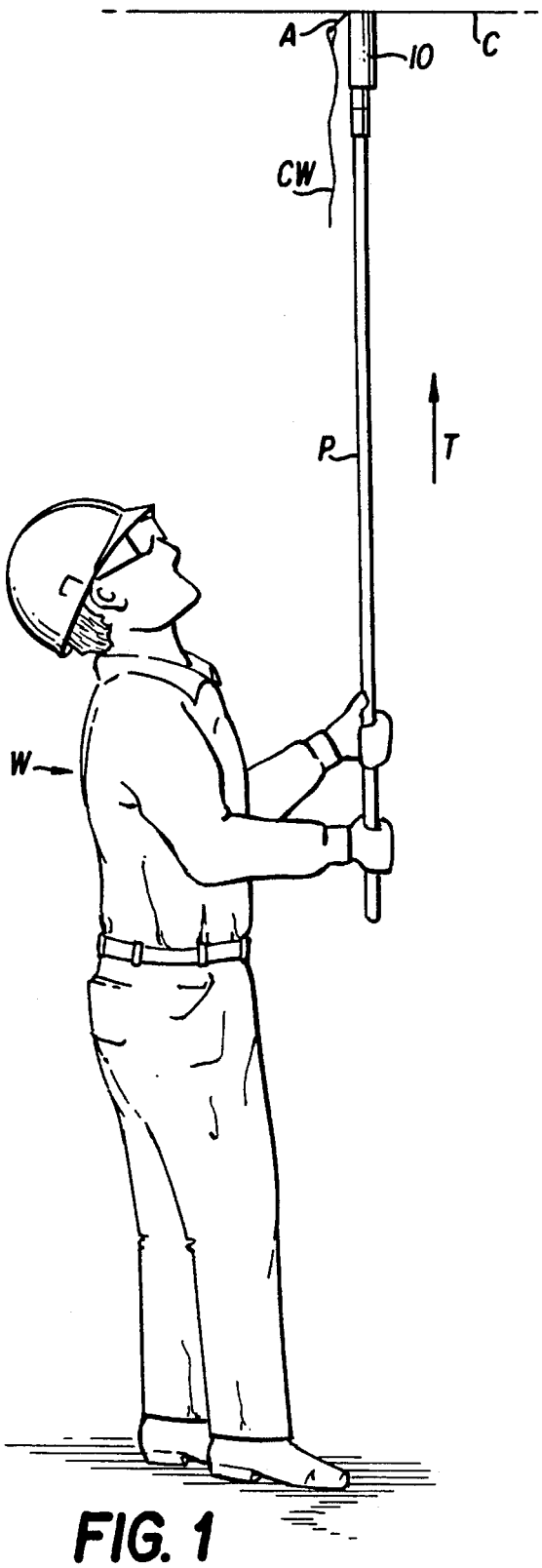
FIG. 1 is a perspective view of a worker using the fastener system of the present invention to install a fastener in a ceiling.
Figure 2:
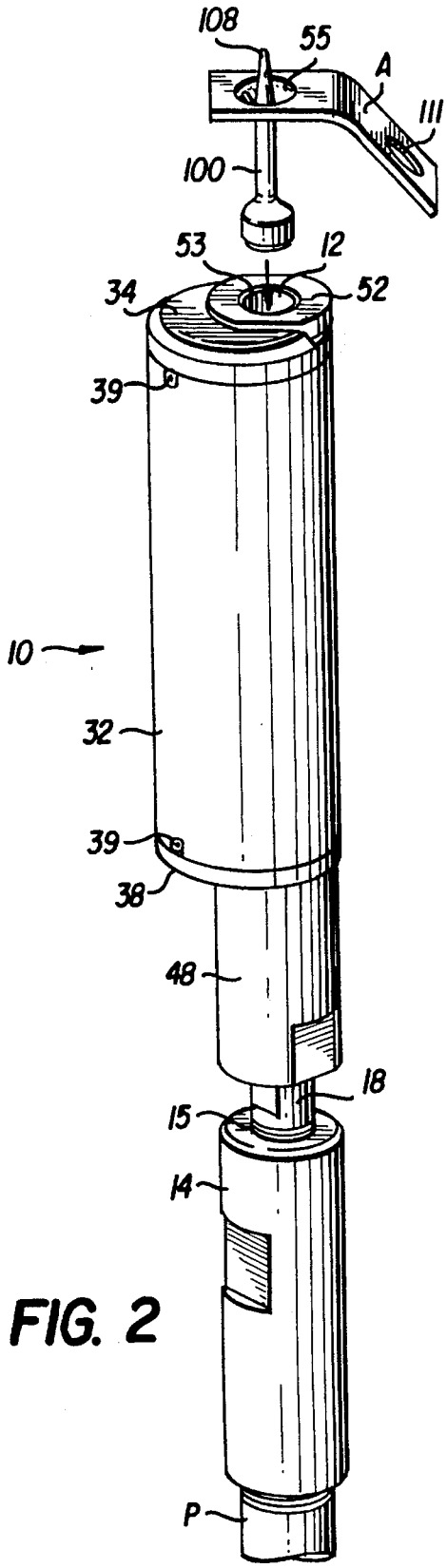
FIG. 2 is a perspective view of a preferred embodiment of the fastener system of the present invention showing a tool and a fastener which together define the system.

FIG. 1 illustrates generally the application of the present invention, showing a worker W fastening a fastener 100 (FIG. 2) having an angle bracket or clip A bearing a ceiling wire CW to a concrete ceiling C using a tool 10 attached to a pole P. FIG. 2 shows a perspective view of a tool 10 according to the present invention having a muzzle 12 for receiving a powered fastener 100 bearing angle clip A. Tool 10 is threadably attached to pole adapter 14 by threads 15 on external shaft 18 of a spring-biased firing rod discussed below. Pole adapter 14 is in turn threadably fastened to pole P. As explained below, by application of a vertical thrusting force T, the worker W is able to actuate the spring-biased firing rod and thereby detonate or ignite the power charge of the powered fastener 100 so as to drive the powered fastener 100 into concrete ceiling C (or other hardened structural member).

Figure 3:
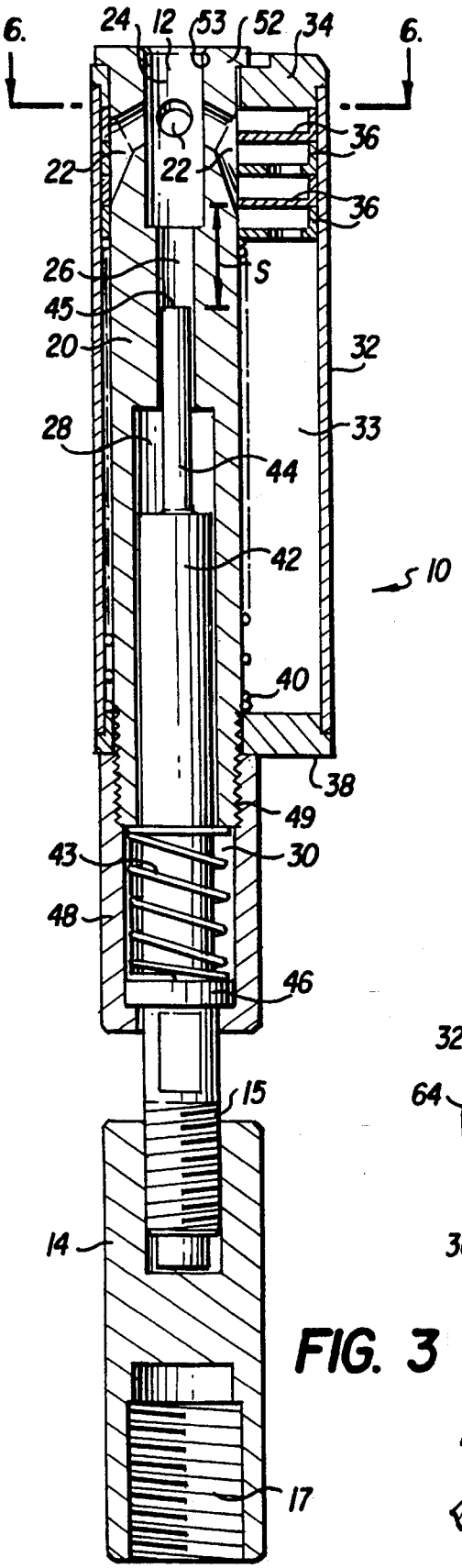
FIG. 3 is a sectional view of a tool according to a preferred embodiment of the present invention.
Figure 10:
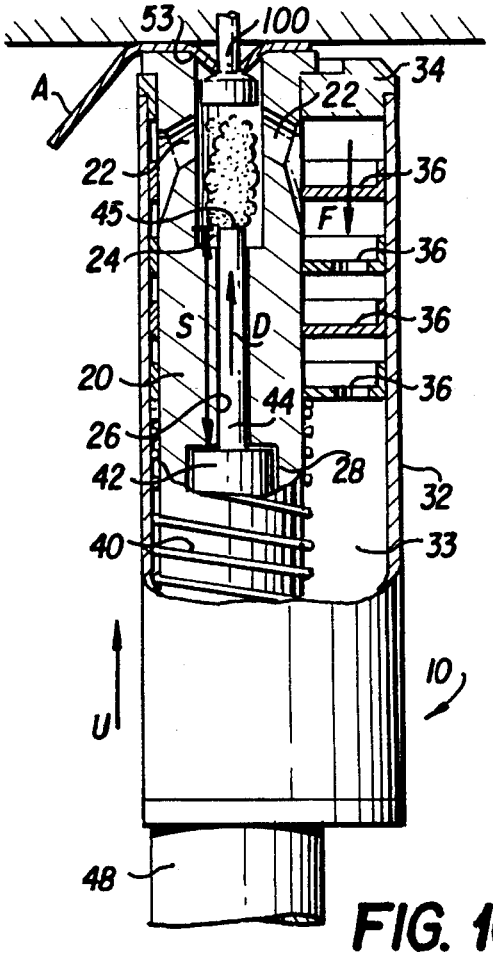
FIG. 10 is a sectional view of the fastener system of the present invention in operation discharging a fastener.
Figure 5:
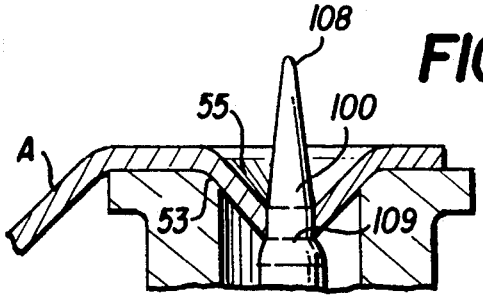
FIG. 5 is a fragmentary sectional view of the muzzle of the tool with a fastener mounted therein in accordance with a preferred embodiment of the present invention.
Figure 4:
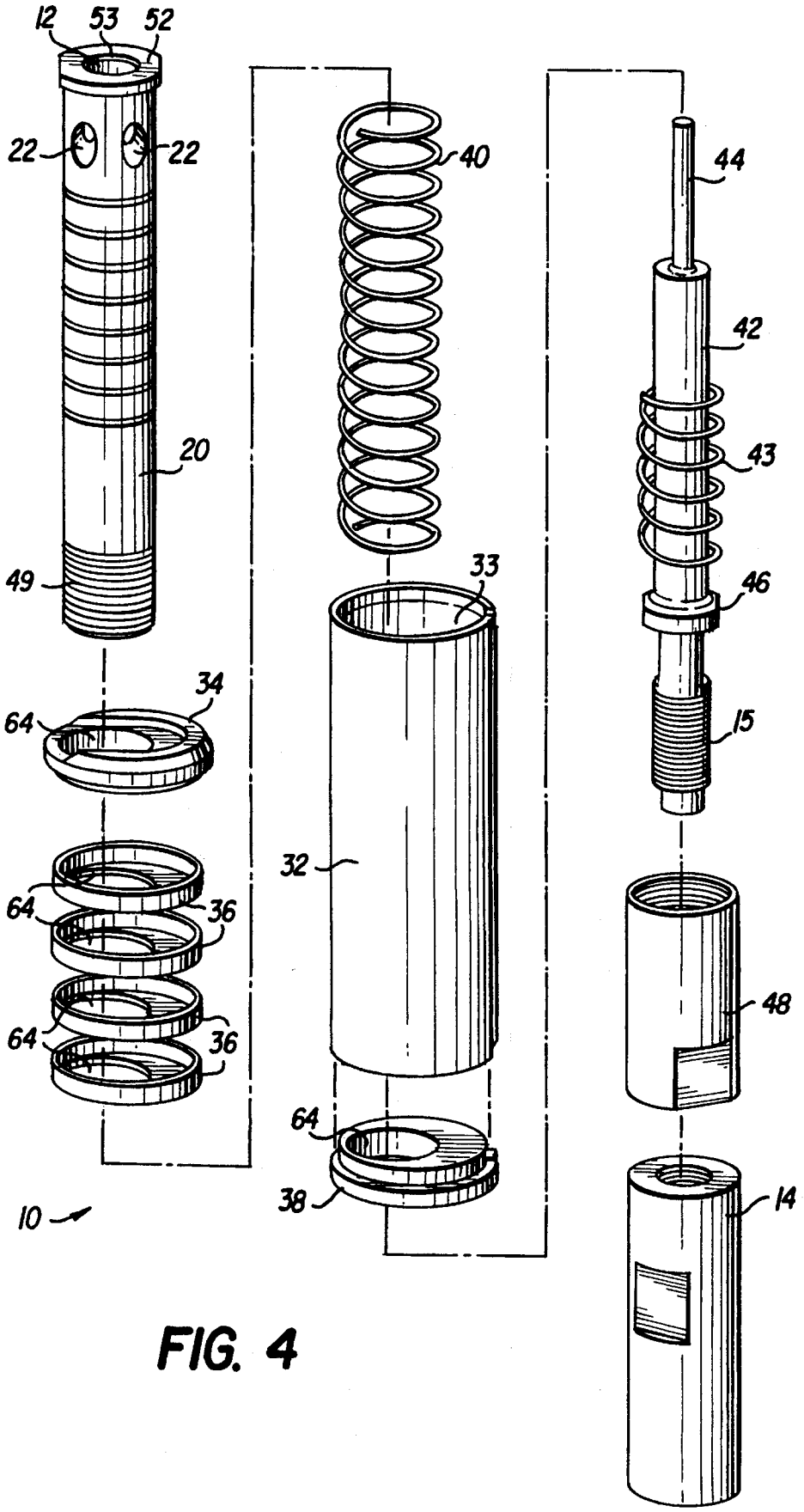
FIG. 4 is an exploded perspective view of a tool according to a preferred embodiment of the present invention.

FIG. 3 is a sectional view of tool 10 in assembled form. FIG. 4 is an exploded perspective view showing the components of tool 10 as they are assembled together to the configuration shown in FIG. 3. As shown in FIGS. 3 and 4, tool 10 is comprised of a barrel 20 having muzzle 12 and exhaust ports 22. Muzzle 12 is the opening to fastener receiving and discharge chamber 24 which communicates with firing pin cylinder 26, firing rod cylinder 28 and firing rod shoulder cylinder 30. Fastener receiving and discharge chamber 24, firing pin cylinder 26, firing rod cylinder 28 and firing rod shoulder cylinder 30 are coaxially aligned. Eccentrically disposed about barrel 20 is an exhaust chamber housing 32 defining exhaust chamber 33 in which are mounted an exhaust chamber housing top end cap 34, a plurality of baffles 36, and exhaust chamber housing bottom end cap 38. End caps 24, 38 are each provided with keys 39 (FIG. 2) which engage and align with housing 32. Baffle spring 40 disposed between end cap 38 and the lowermost baffle 36, biases baffles 36 into the upper region of exhaust chamber 33 proximate to exhaust ports 22. Firing rod 42 having firing pin 44 and firing rod shoulder 46 is slidably and reciprocatingly disposed within barrel 20. Firing pin 44 has tip 45 and is disposed so as to reciprocate within firing pin cylinder 26 and extend into the lower region of fastener receiving and discharge chamber 24, thereby having a stroke S. Firing rod 42 reciprocates within firing rod cylinder 28 and extends into firing rod shoulder cylinder 30 defined by firing rod shoulder housing 48 which is threadably engaged by threads 49 with the bottom of barrel 20. The stroke of firing rod 42 is approximately 1 inch. Firing rod 42 is biased by spring 43 disposed within firing rod shoulder cylinder 30. The bottom of firing rod 42 is threadably engaged by threads 15 with pole adapter 14 which is threadably engageable by threads 17 with pole P (FIGS. 1 and 2). Exhaust chamber housing 32 is held in position at top end cap 34 by barrel rim 52 and biased against barrel rim 52 by firing rod shoulder housing 48 contacting bottom end cap 38. As shown in FIG. 5, muzzle 12 has beveled entrance 53 so as to accommodate a fastener 100 having pointed end or tip 108 with an angle clip A attached thereto and at fastener shoulder or step 109. Angle clip A will typically have a long ceiling wire CW attached thereto at hole 111 (FIG.2). Angle clip A has inverted conical concave surface 55 which is shaped to fit within beveled entrance 53. This surface 55 serves to support and guide the fastener 100 as it is driven. Surface 55 also assists in stopping the fastener 100, should the fastener 100 be driven into a softer material than anticipated. The eccentric offset of housing 32 permits proper alignment of the combined fastener 100 and angle clip A.

Figure 6:
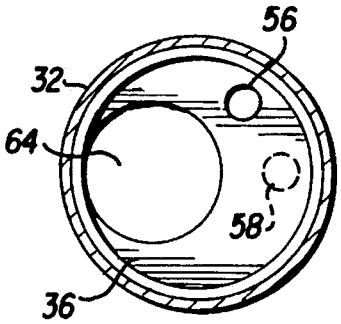
FIG. 6 is a sectional view taken along line 6—6 of FIG. 3.

Sectional end view 6—6 of FIG. 3 is shown in FIG. 6. Therein are shown the eccentric or off-center holes 64 for accommodating barrel 20. Exhaust holes 56, 58 (in phantom) are shown. The exhaust holes are 0 staggered, as shown, between successive baffles so as to effect a tortuous, rather than direct, flow path F (FIG. 11) of the exhaust gases from fastener receiving and discharge chamber 24 through exhaust ports 22 into exhaust chamber 33. The baffles 36 are arranged eccentrically around barrel 20 in accordance with the eccentric alignment of housing 32.

Figure 7:
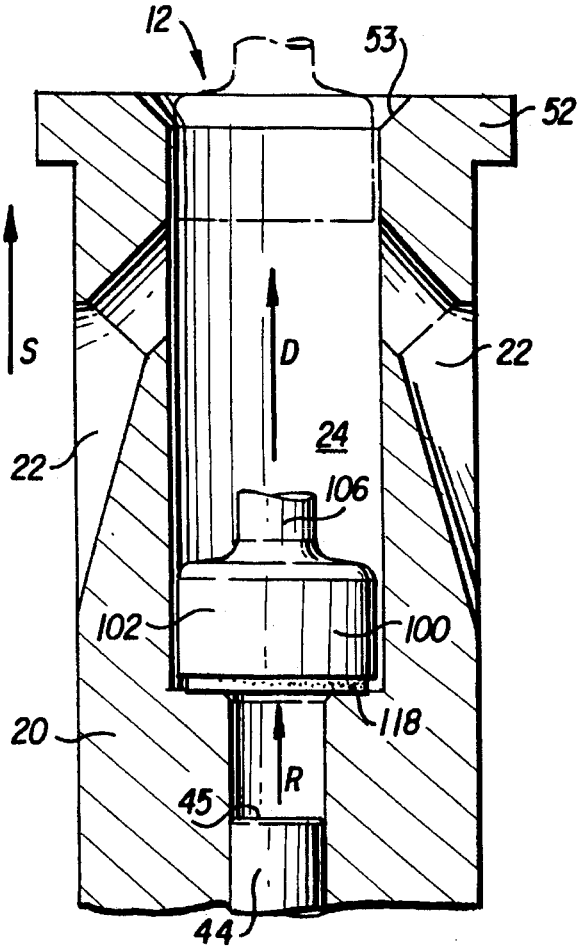
FIG. 7 is a fragmentary sectional view of the fastener receiving chamber of the tool with a fastener received therein.

FIG. 7 shows the positioning of a powered fastener 100 in fastener receiving and discharge chamber 24, with the reciprocating motion R of firing pin 44 and discharge direction D shown. As explained below, fastener receiving and discharge chamber 24 cooperates with fastener head 102 receptacle 104 to create a combustion chamber for the power charge 118 which is placed in receptacle 104.

Figure 8:
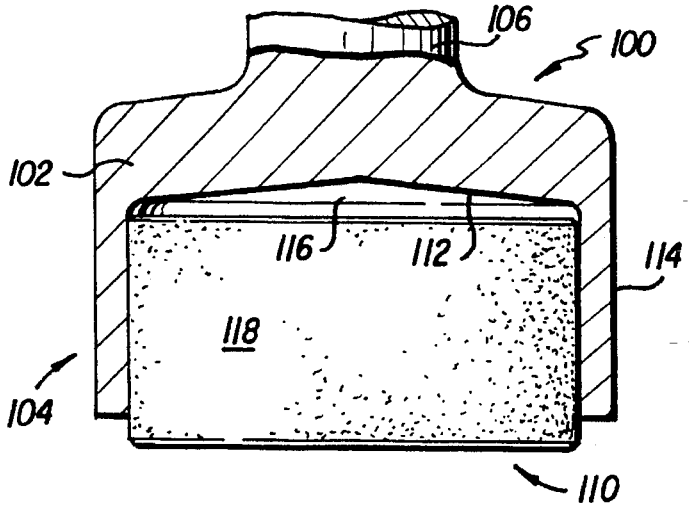
FIG. 8 is a fragmentary sectional view of a first embodiment of a fastener having a power charge.
Figure 9:
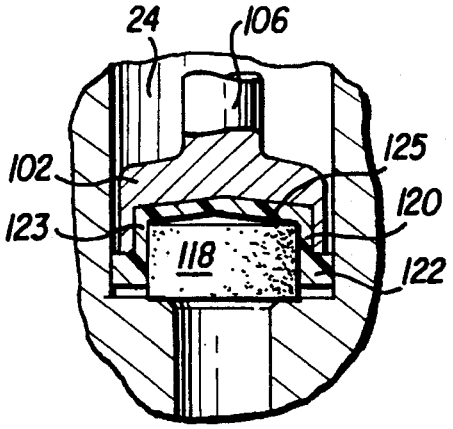
FIG. 9 is a fragmentary sectional view of an alternative embodiment of a fastener bearing a power charge.

FIGS. 8 and 9 illustrate the details of fastener 100. Head 102 is formed integrally with shaft 106, having a penetration end, typically in the form of point or tip 108 (FIG. 5) and provided with an essentially cylindrical open end 110 having a shallow conical surface 112. Cylindrical wall 114 and conical surface 112 define a receiving and combustion chamber 116 within fastener 100 for receiving a charge 118 of combustible material.

Charge 118 may be made of any suitable material which will sustain a burn throughout the traversal of fastener 100 along the receiving and discharge chamber 24. A preferred material is a nitrocellulose compound or composition having in excess of 85 wt % nitrocellulose, and also having suitable stabilizers, crafts and resins, as known in the art, which result in a density and porosity which permit a rapid burn rate upon detonation. Such compound eliminates the requirement of a primer. A source of such compound is Armtec Defense Products Co., Coachella, Calif. An advantage of this particular power charge material is that virtually complete consumption of the power charge occurs when detonated.

The power charge 118 is formed into a pellet or plug which is press fit into receptacle 104. One means of mounting power charge 118 is to use the receptacle 104 to punch a pellet-shaped plug out of a sheet or strip of power charge material in cookie-cutter fashion, with the resulting plug being press fit within receptacle 104. Alternatively, an adhesive can be applied to adhere the charge to the inside surface of cylindrical wall 114. The charge 118 may be flush with the opening of head 102 (FIG. 8) or may protrude slightly beyond the opening (FIGS. 7 and 9).

FIG. 9 shows an alternative embodiment of a charge 118 mounted in fastener 100 by an insert 120 which has rim 122 for close proximity to receiving and discharge chamber 24. The insert 120 has both cylindrical 123 and conical 125 portions, as in the first embodiment.

The tool 10 and fastener 100 may be made of any suitable material as known in the art. Typically, the firing rod 42 is made type S7 tool steel, other parts of tool 10 are made of type 4140 tool steel, with the housing 32 made of compression pipe stainless steel. The pole P is made of aluminum or fiberglass. The fastener 200 is made of type 1062 wire.

It is contemplated that the stroke S of tool 10 can be altered by changing the appropriate dimensions of the consitituent parts, in order to drive a fastener 100 of increased length. Such would be the case when a fastener 100 is to be driven through several inches of wood into a concrete or steel surface. Normally, only a one inch penetration into concrete is required. However, the length of the fastener would be increased to go through such a combined structure. Therefore, the stroke would have to be increased from approximately 1 inch to approximately 5 inches. Of course, the stroke could be altered for other lengths.

Referring now to the FIGS., the operation of the system is as follows:

A fastener 100 having angle clip A slidably attached near the point 108 of the fastener is placed in muzzle 12 of tool 10. Angle clip A rests in beveled entrance 53. Tool 10 is threadably fastened to pole P. Penetration end or point 108 is placed against the work surface, for example, ceiling C, with the tool 10 held in an essentially vertical orientation. A vertical upward thrusting force T is applied to pole P to compress biasing spring 43 and to cause firing rod 42 to move upwardly toward fastener 100. The typical thrusting force is on the order of 20–30 pounds, which is within the capability of the ordinary worker in the field. The tip 45 of firing pin 44 has a diameter of approximately 0.100 inch corresponding to an area of approximately 0.00786 square inches, resulting in a pressure of on the order of 2500–4000 pounds/square inch. Pressures as high as 6000 pounds/square inch are contemplated. As shown in FIG. 11, firing pin 44 penetrates power charge 118 disposed in receptacle 104 of fastener 100 to a depth of approximately 0.080–0.100 inch. This penetration causes a shearing action and deformation of the power charge material. Friction is also generated which is sufficient to ignite or detonate power charge 118. Because fastener 100 extends substantially over the diameter of the bore of fastener receiving and discharge chamber 24, the space defined by receptacle 104 including the conical surface 112 and the portion of receiving and discharge chamber 24 beneath receptacle 104 defines the expanding combustion chamber in which the power charge rapidly burns and through which the fastener 100 travels. The pressure exerted by expanding gases drives the fastener 100 into the work surface C. As the receptacle 104 of fastener 100 clears the exhaust ports 22, the exhaust gases are forced into exhaust chamber 33 of exhaust chamber housing 32. The pressure of the exhaust gases flowing through baffles 36 expands the spring-biased baffles 36, thereby compressing baffle spring 40. This dissipates the energy of the gases, thereby reducing the noise of the discharge of the fastener 100 from muzzle 12. Simultaneously with the discharge of fastener 100 from chamber 24, spring 43 serves to force barrel 20 (and hence the remainder of tool 10) upwardly (shown as direction U) such that rim 52 contacts work surface C. This action restores the firing rod shoulder 46, firing rod 42 and firing pin 44 to their respective rest positions, with firing rod shoulder 46 in contact with the base 51 of firing rod shoulder housing 48.

As will be noted by one skilled in the art, this operation requires the fastener 100 to be held against a hardened work surface in order for the firing pin 44 to ignite or detonate the power charge 118. Thus, the likelihood of discharging a fastener directly into an unwanted surface, such as a worker's hand, is significantly reduced. In addition, no free flight of the fastener is achieved, yet the fastener can be satisfactorily driven into a hardened work surface.

It is contemplated that the firing pin 44 may be stepped down or otherwise shaped at the tip 45 so as to reduce the area contacting the power charge 104. This will result in increased pressures for the same applied thrusting force T.

It is contemplated that the extent to which the point 108 extends out of the muzzle 12 can be altered by the shape and extent of the beveled entrance 53.

The tool 10 and fastener 100 have been shown as operating in a vertically upward direction. It is also contemplated that the tool and fastener system in accordance with the present invention can be operated in other orientations.

Although certain presently preferred embodiments of the invention have been described herein, it will be apparent to those skilled in the art to which the invention pertains that variations and modifications of the described embodiments may be made without departing from the spirit and scope,of the invention. Accordingly, it is intended that the invention be limited only to the extent required by the appended claims and the applicable rules of law.

What is claimed is:

1. A tool for driving a powered fastener into a work surface, said fastener including a shaft, a penetration end and a receptacle head end having a cavity for receiving a power charge, and a power charge received in said cavity, said tool comprising:

a barrel bore having a muzzle for receiving said fastener, a surface for supporting said fastener in a stationary position, a spring-biased firing pin for driving into said power charge to ignite said power charge, and an exhaust chamber connected to said bore for receiving exhaust gases, wherein said tool receives said fastener such that said fastener penetration end extends out of said muzzle prior to firing and is to be placed in contact with said work surface, wherein said work surface, said fastener penetration end, said fastener receptacle head end, said supporting surface and said firing pin cooperate to ignite said power charge to drive said fastener into said work surface.

2. A tool as in claim 1, further comprising a plurality of baffles disposed in said exhaust chamber and biased therein by a spring, said baffles being interconnected by air passages and having spaces therebetween, said spaces being expandable as exhaust gases enter said baffles and compress said spring, thereby serving to reduce the sound of detonation in said tool.

3. A tool as in claim 1, further comprising a plurality of frusto-conical exhaust ports leading from said bore to said exhaust chamber.

4. A tool as in claim 1, further comprising a beveled entrance to said muzzle for accommodating an angle clip arranged on said powered fastener.

5. A tool as in claim 1, further comprising a firing rod bearing said firing pin, said firing rod having a shoulder which is biased by a spring.

6. A tool as in claim 1, further comprising an end adapted to threadably engage a pole.

7. A tool as in claim 1, wherein said exhaust chamber comprises a housing which is eccentrically mounted around said barrel.

8. A tool as in claim 1, wherein said tool has a stroke of approximately 1 inch.

9. A tool as in claim 1, wherein said tool has a stroke of approximately 5 inches.

10. A tool for driving a powered fastener into a work surface, said fastener including a shaft, a penetration end and a receptacle head end having a cavity for receiving a power charge, and a power charge received in said cavity, said tool comprising:

a barrel bore having a muzzle for receiving said fastener, a surface for supporting said fastener in a stationary position, and a spring-biased firing pin for driving into said power charge to ignite said power charge, wherein said tool receives said fastener such that said fastener penetration end extends out of said muzzle prior to firing and is to be placed in contact with said work surface, wherein said work surface, said fastener penetration end, said fastener receptacle head end, said supporting surface and said firing pin cooperate to ignite said power charge to drive said fastener into said work surface.

* * * * *